US009494896B2

(12) United States Patent
Yamaji et al.

(10) Patent No.: US 9,494,896 B2
(45) Date of Patent: Nov. 15, 2016

(54) FIXING DEVICE WITH SEPARATION PLATE AND IMAGE FORMING APPARATUS THEREOF

(71) Applicants: Kensuke Yamaji, Kanagawa (JP); Takuya Seshita, Kanagawa (JP); Takahiro Imada, Kanagawa (JP); Hajime Gotoh, Kanagawa (JP); Akira Suzuki, Tokyo (JP)

(72) Inventors: Kensuke Yamaji, Kanagawa (JP); Takuya Seshita, Kanagawa (JP); Takahiro Imada, Kanagawa (JP); Hajime Gotoh, Kanagawa (JP); Akira Suzuki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/186,078

(22) Filed: Feb. 21, 2014

(65) Prior Publication Data

US 2014/0270865 A1 Sep. 18, 2014

(30) Foreign Application Priority Data

Mar. 12, 2013 (JP) ..... 2013-049461

(51) Int. Cl.
*G03G 15/20* (2006.01)

(52) U.S. Cl.
CPC ..... *G03G 15/2028* (2013.01); *G03G 15/2085* (2013.01)

(58) Field of Classification Search
CPC ..... G03G 15/2028; G03G 15/2085
USPC ..... 399/323
See application file for complete search history.

(56) References Cited

U.S. PATENT DOCUMENTS

| | | | | |
|---|---|---|---|---|
| 2004/0067080 | A1 | 4/2004 | Berg et al. | |
| 2007/0166083 | A1* | 7/2007 | Satoh et al. | 399/323 |
| 2007/0231024 | A1* | 10/2007 | Inomata | 399/322 |
| 2007/0292175 | A1 | 12/2007 | Shinshi | |

(Continued)

FOREIGN PATENT DOCUMENTS

| | | | |
|---|---|---|---|
| CN | 1914564 | A | 2/2007 |
| CN | 102854782 | A | 1/2013 |

(Continued)

OTHER PUBLICATIONS

Office Action for corresponding Chinese application No. 201410076895.7 dated Sep. 14, 2015.

*Primary Examiner* — David Gray
*Assistant Examiner* — Laura Roth
(74) *Attorney, Agent, or Firm* — Harness, Dickey & Pierce, P.L.C.

(57) ABSTRACT

A fixing device includes a fixing rotary body rotatable in a given direction of rotation and a heater disposed opposite the fixing rotary body to heat the fixing rotary body. A pressing rotary body contacts the fixing rotary body to form a fixing nip therebetween through which a recording medium is conveyed. A separator is disposed downstream from the fixing nip in a recording medium conveyance direction to separate the recording medium from one of the fixing rotary body and the pressing rotary body. The separator includes a separation plate including an upstream portion disposed opposite the fixing nip and at least one slot disposed downstream from the upstream portion in the recording medium conveyance direction.

17 Claims, 9 Drawing Sheets

(56) References Cited

U.S. PATENT DOCUMENTS

| | | | | |
|---|---|---|---|---|
| 2008/0143038 | A1* | 6/2008 | Uehara | B65H 29/52 271/18 |
| 2011/0222926 | A1 | 9/2011 | Ueno et al. | |
| 2012/0207523 | A1 | 8/2012 | Ueno et al. | |
| 2013/0004213 | A1 | 1/2013 | Takahashi | |
| 2013/0170877 | A1 | 7/2013 | Yoshiura et al. | |
| 2013/0189005 | A1 | 7/2013 | Saito et al. | |
| 2013/0236225 | A1 | 9/2013 | Ogawa et al. | |
| 2013/0251417 | A1* | 9/2013 | Ishimori | 399/323 |

FOREIGN PATENT DOCUMENTS

| | | | | | |
|---|---|---|---|---|---|
| JP | 2004-205750 | A | | 7/2004 | |
| JP | 2005338315 | A | * | 12/2005 | G03G 15/20 |
| JP | 2007-047379 | A | | 2/2007 | |
| JP | 2007-334205 | | | 12/2007 | |

* cited by examiner

FIXING DEVICE WITH SEPARATION PLATE AND IMAGE FORMING APPARATUS THEREOF

CROSS-REFERENCE TO RELATED APPLICATION

This patent application is based on and claims priority pursuant to 35 U.S.C. §119 to Japanese Patent Application No. 2013-049461, filed on Mar. 12, 2013, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The fixing device may include a fixing rotary body, such as a roller, a belt, and a film, and a pressing rotary body, such as a roller and a belt, pressed against the fixing rotary body to form a fixing nip therebetween through which a recording medium bearing an unfixed toner image is conveyed. As the recording medium is conveyed through the fixing nip, the fixing rotary body heated by a heater and the pressing rotary body apply heat and pressure to the recording medium, fixing the toner image on the recording medium.

The fixing device is requested to shorten a warm-up time taken to heat the fixing device from an ambient temperature to a desired fixing temperature to fix the toner image on the recording medium after the image forming apparatus is powered on. The fixing device is also requested to shorten a first print time taken to output a recording medium bearing a fixed toner image onto an outside of the image forming apparatus after the image forming apparatus receives a print job.

To address those requests, the fixing device may employ a ceramic heater disposed opposite the fixing rotary body at the fixing nip. However, since the ceramic heater heats the fixing rotary body at the fixing nip, the fixing rotary body has a decreased temperature at an entry to the fixing nip situated upstream from the ceramic heater in a rotation direction of the fixing rotary body, resulting faulty fixing.

On the other hand, since the image forming apparatus is requested to print quickly, an increased number of recording media is conveyed through the fixing device per minute. Accordingly, the fixing device requires an increased amount of heat to be supplied to the recording media. Consequently, upon start of a print job for printing on a plurality of recording media continuously, the fixing device may suffer from shortage of heat.

To address those circumstances, a fixing device 80R shown in FIG. 1 is proposed by JP-4818826-B2 (JP-2007-334205-A). FIG. 1 is a schematic vertical sectional view of the fixing device 80R.

As shown in FIG. 1, the fixing device 80R includes an endless belt 201 rotatable counterclockwise in FIG. 1; a tubular, metal thermal conductor 202 stationarily disposed inside the endless belt 201 to guide the endless belt 201; a heater 203 situated inside the metal thermal conductor 202 to heat the endless belt 201 through the metal thermal conductor 202; and a pressure roller 204 pressed against the metal thermal conductor 202 via the endless belt 201 to form a fixing nip 207 between the endless belt 201 and the pressure roller 204. As the pressure roller 204 rotates clockwise in FIG. 1, the endless belt 201 rotates counterclockwise in FIG. 1 in accordance with rotation of the pressure roller 204. The metal thermal conductor 202 heated by the heater 203 in turn heats the endless belt 201 entirely, shortening the first print time and overcoming shortage of heat. Alternatively, the metal thermal conductor 202 may be eliminated to allow the heater 203 to heat the endless belt 201 directly.

However, since heat from the heater 203 is concentrated on the endless belt 201, peripheral components other than the endless belt 201 may be heated slowly and therefore susceptible to condensation. For example, condensation occurs on a separator disposed downstream from the fixing nip 207 in a recording medium conveyance direction D1 to separate a recording medium S from the endless belt 201. If condensation occurs, as the recording medium S is conveyed over the separator, droplets may adhere from the separator to the recording medium S, damaging the toner image on the recording medium S.

SUMMARY

At least one embodiment provides a novel fixing device that includes a fixing rotary body rotatable in a given direction of rotation and a heater disposed opposite the fixing rotary body to heat the fixing rotary body. A pressing rotary body contacts the fixing rotary body to form a fixing nip therebetween through which a recording medium is conveyed. A separator is disposed downstream from the fixing nip in a recording medium conveyance direction to separate the recording medium from one of the fixing rotary body and the pressing rotary body. The separator includes a separation plate including an upstream portion disposed opposite the fixing nip and having a volume not greater than about 1.8 $mm^3$ per unit length of 1 mm of the upstream portion in an axial direction of the one of the fixing rotary body and the pressing rotary body and at least one slot disposed downstream from the upstream portion in the recording medium conveyance direction.

At least one embodiment provides a novel image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
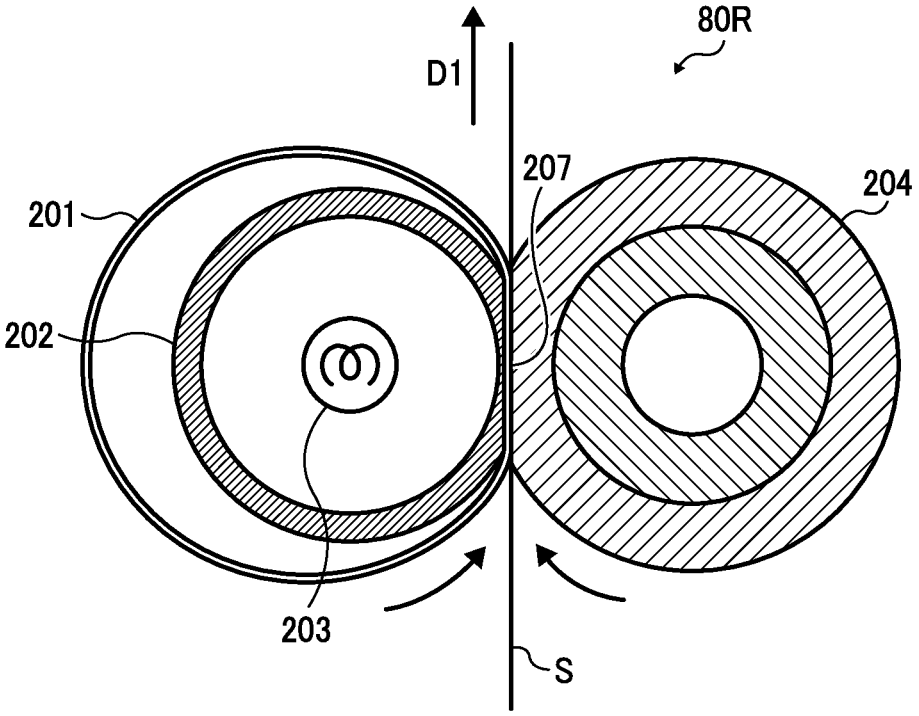
FIG. 1 RELATED ART
FIG. 1 is a vertical sectional view of a related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
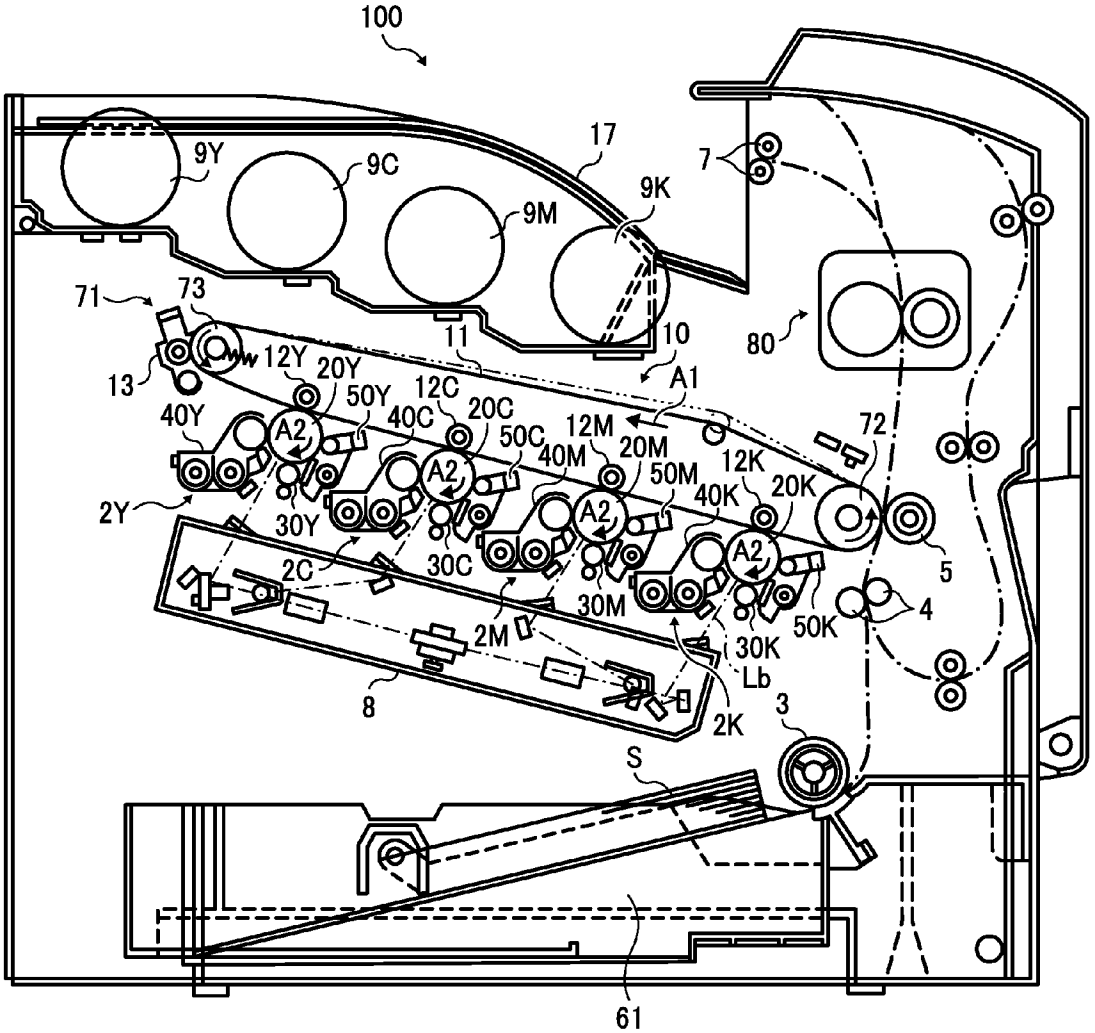
FIG. 2 is a schematic vertical sectional view of an image forming apparatus according to an example embodiment of the present invention.

Referring now to the drawings, wherein like reference numerals designate identical or corresponding parts throughout the several views, particularly to FIG. 2, an image forming apparatus 100 according to an example embodiment is explained.

FIG. 2 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 100 is a tandem color printer that forms color and monochrome toner images on recording media by electrophotography.

As shown in FIG. 2, the image forming apparatus 100 is a tandem color printer that includes four imaging stations 2Y, 2C, 2M, and 2K for forming yellow, cyan, magenta, and black toner images, respectively, that are aligned in a stretch direction of an intermediate transfer belt 11. However, the image forming apparatus 100 is not limited to the tandem printer.

The imaging stations 2Y, 2C, 2M, and 2K include photoconductive drums 20Y, 20C, 20M, and 20K serving as image carriers for carrying electrostatic latent images and resultant yellow, cyan, magenta, and black toner images, respectively. The photoconductive drums 20Y, 20C, 20M, and 20K are aligned in tandem with each other.

The yellow, cyan, magenta, and black toner images formed on the photoconductive drums 20Y, 20C, 20M, and 20K are primarily transferred onto the intermediate transfer belt 11 serving as an intermediate transferor disposed opposite the photoconductive drums 20Y, 20C, 20M, and 20K. The intermediate transfer belt 11 is an endless belt rotatable in a rotation direction A1. The yellow, cyan, magenta, and black toner images are superimposed on a same position on the intermediate transfer belt 11 and secondarily transferred onto a recording medium S (e.g., a sheet) collectively.

The photoconductive drums 20Y, 20C, 20M, and 20K are surrounded by various devices used to form the yellow, cyan, magenta, and black toner images on the photoconductive drums 20Y, 20C, 20M, and 20K rotating clockwise in FIG. 2 in a rotation direction A2. Taking the photoconductive drum 20K used to form a black toner image as an example, the photoconductive drum 20K is surrounded by a charger 30K, a development device 40K, a primary transfer roller 12K serving as a primary transferor, and a cleaner 50K, which are arranged in the rotation direction A2 of the photoconductive drum 20K. After the charger 30K charges an outer circumferential surface of the photoconductive drum 20K, an optical writer 8 exposes the charged outer circumferential surface of the photoconductive drum 20K, writing an electrostatic latent image on the photoconductive drum 20K.

As the intermediate transfer belt 11 rotates in the rotation direction A1, the yellow, cyan, magenta, and black toner images formed on the photoconductive drums 20Y, 20C, 20M, and 20K are primarily transferred onto the intermediate transfer belt 11 such that the yellow, cyan, magenta, and black toner images are superimposed on the same position on the intermediate transfer belt 11. For example, as the primary transfer rollers 12Y, 12C, 12M, and 12K are applied with a voltage, the primary transfer rollers 12Y, 12C, 12M, and 12K primarily transfer the yellow, cyan, magenta, and black toner images onto the intermediate transfer belt 11 from the upstream photoconductive drum 20Y to the downstream photoconductive drum 20K in the rotation direction A1 of the intermediate transfer belt 11 at different times. The primary transfer rollers 12Y, 12C, 12M, and 12K are disposed opposite the photoconductive drums 20Y, 20C, 20M, and 20K via the intermediate transfer belt 11 such that the yellow, cyan, magenta, and black toner images are superimposed on the same position on the intermediate transfer belt 11 to form a color toner image as the yellow, cyan, magenta, and black toner images are primarily transferred onto the intermediate transfer belt 11 successively. The photoconductive drums 20Y, 20C, 20M, and 20K are aligned in this order in the rotation direction A1 of the intermediate transfer belt 11.

The image forming apparatus 100 further includes a transfer belt unit 10, a secondary transfer roller 5, and a belt cleaner 13 that cleans the intermediate transfer belt 11. The transfer belt unit 10 is situated above and disposed opposite the photoconductive drums 20Y, 20C, 20M, and 20K and includes the intermediate transfer belt 11 and the primary transfer rollers 12Y, 12C, 12M, and 12K. The secondary transfer roller 5 serving as a secondary transferor is disposed opposite the intermediate transfer belt 11 and rotates in accordance with rotation of the intermediate transfer belt 11 that rotates in the rotation direction A1. The belt cleaner 13 is disposed opposite the intermediate transfer belt 11 and cleans an outer circumferential surface of the intermediate transfer belt 11.

The optical writer 8 is situated below and disposed opposite the four imaging stations 2Y, 2C, 2M, and 2K. The optical writer 8 includes a semiconductor laser serving as a light source, a coupling lens, an f-θ lens, a troidal lens, a deflection mirror, and a rotatable polygon mirror serving as a deflector. The optical writer 8 emits laser beams Lb corresponding to yellow, cyan, magenta, and black image data contained in image data sent from an external device such as a client computer onto the photoconductive drums 20Y, 20C, 20M, and 20K, thus forming electrostatic latent images thereon.

The image forming apparatus 100 further includes a sheet feeder 61 and a registration roller pair 4. The sheet feeder 61 includes a paper tray that loads a plurality of recording media S (e.g., sheets) to be conveyed to a secondary transfer nip formed between the secondary transfer roller 5 and the intermediate transfer belt 11. The recording media S may be plain paper, coated paper, sensitive paper, electrostatic recording paper, thin paper, thick paper, postcards, overheat projector (OHP) transparencies, and the like.

The registration roller pair 4 feeds a recording medium S conveyed from the sheet feeder 61 to the secondary transfer nip at a proper time when the yellow, cyan, magenta, and black toner images superimposed on the intermediate transfer belt 11 reach the secondary transfer nip. The image forming apparatus 100 further includes a sensor that detects a leading edge of the recording medium S as it reaches the registration roller pair 4.

The image forming apparatus 100 further includes a fixing device 80, an output roller pair 7, an output tray 17, and toner bottles 9Y, 9C, 9M, and 9K. The fixing device 80 fixes the color toner image secondarily transferred from the intermediate transfer belt 11 onto the recording medium S thereon. The output roller pair 7 discharges the recording medium S bearing the fixed color toner image onto an outside of the image forming apparatus 100, that is, the output tray 17. The output tray 17, disposed atop the image forming apparatus 100, stocks the recording medium S discharged by the output roller pair 7. The toner bottles 9Y, 9C, 9M, and 9K are situated below the output tray 17 and contain fresh yellow, cyan, magenta, and black toners, respectively.

The transfer belt unit 10 includes a driving roller 72 and a driven roller 73 in addition to the intermediate transfer belt 11 and the primary transfer rollers 12Y, 12C, 12M, and 12K. The intermediate transfer belt 11 is stretched taut across the driving roller 72 and the driven roller 73. The driven roller 73 exerts tension to the intermediate transfer belt 11. For example, the driven roller 73 is attached with a biasing member such as a spring that presses the driven roller 73 against the belt cleaner 13 via the intermediate transfer belt 11. Thus, the driven roller 73 also stretches the intermediate transfer belt 11. The transfer belt unit 10, the primary transfer rollers 12Y, 12C, 12M, and 12K, the secondary transfer roller 5, and the belt cleaner 13 constitute a transfer device 71.

The sheet feeder 61 is situated in a lower portion of the image forming apparatus 100 and includes a feed roller 3 that contacts an upper face of an uppermost recording medium S of the plurality of recording media S loaded on the paper tray. As the feed roller 3 rotates counterclockwise in FIG. 2, the feed roller 3 feeds the uppermost recording medium S toward the registration roller pair 4.

The belt cleaner 13 of the transfer device 71 includes a cleaning brush and a cleaning blade disposed opposite and in contact with the outer circumferential surface of the intermediate transfer belt 11. The cleaning brush and the cleaning blade scrape and remove a foreign substance such as residual toner off the intermediate transfer belt 11, thus cleaning the intermediate transfer belt 11. The belt cleaner 13 further includes a waste toner discharger that discharges the residual toner collected from the intermediate transfer belt 11 into a waste toner container.

Figure 3:
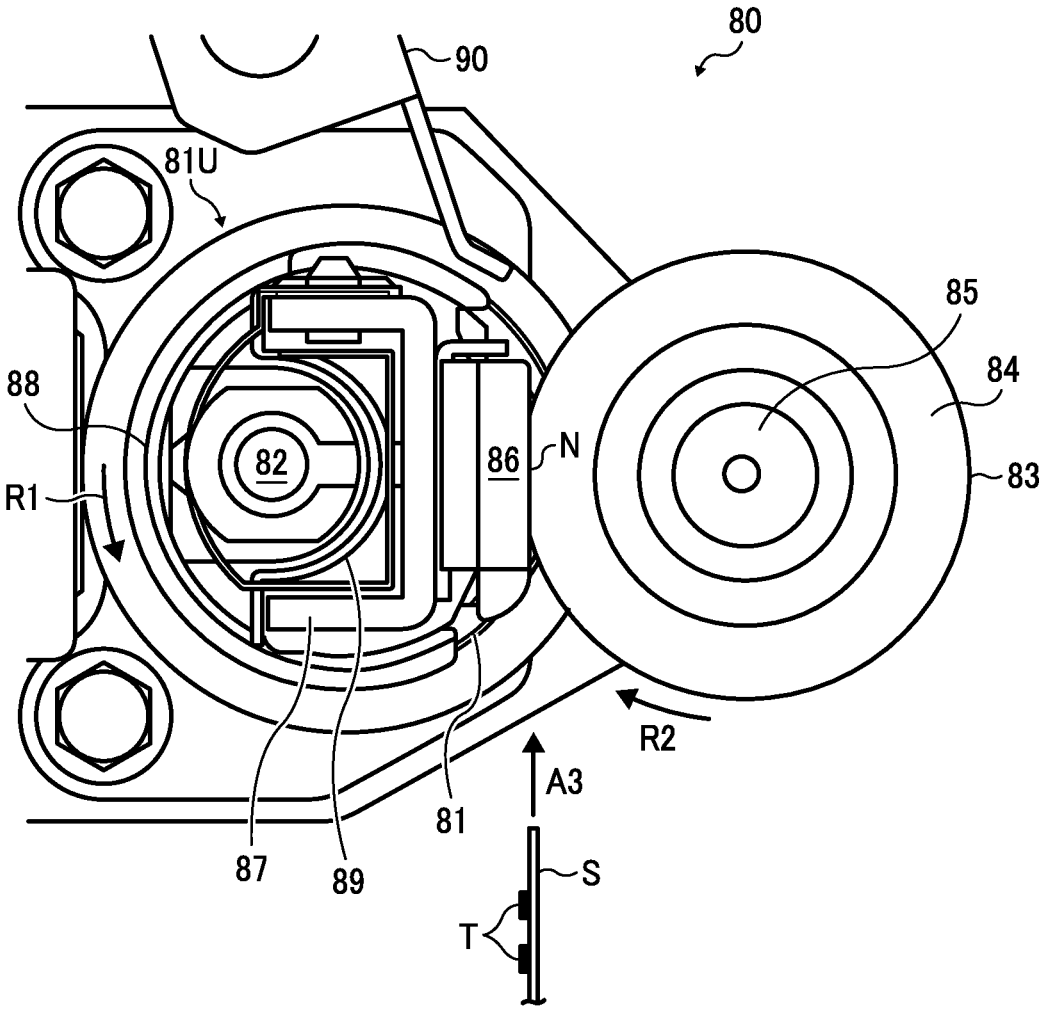
FIG. 3 is a vertical sectional view of a fixing device incorporated in the image forming apparatus shown in FIG. 2.

With reference to FIG. 3, a description is provided of a construction of the fixing device 80 incorporated in the image forming apparatus 100 described above.

FIG. 3 is a vertical sectional view of the fixing device 80. As shown in FIG. 3, the fixing device 80 (e.g., a fuser) includes an endless fixing belt 81 serving as a fixing rotary body or an endless belt formed into a loop and rotatable in a rotation direction R1; a pressure roller 83 serving as a pressing rotary body contacting an outer circumferential surface of the fixing belt 81 and rotatable in a rotation direction R2 counter to the rotation direction R1 of the fixing belt 81; and a heater 82 (e.g., a halogen heater) disposed inside the loop formed by the fixing belt 81 and heating the fixing belt 81 directly with radiation heat. The fixing device 80 further includes a nip formation pad 86, a support 87, a holder pair 88, and a reflector 89 disposed inside the loop formed by the fixing belt 81. The fixing belt 81 and the components disposed inside the loop formed by the fixing belt 81, that is, the heater 82, the nip formation pad 86, the support 87, the holder pair 88, and the reflector 89, may constitute a belt unit 81U separably coupled with the pressure roller 83.

The nip formation pad 86 disposed inside the loop formed by the fixing belt 81 presses against the pressure roller 83 via the fixing belt 81 to form a fixing nip N between the fixing belt 81 and the pressure roller 83. An inner circumferential surface of the fixing belt 81 slides over the nip formation pad 86 directly or indirectly via a slide sheet. A shaft mounting the fixing belt 81 is parallel to a shaft mounting the pressure roller 83. As the pressure roller 83 pressed against the fixing belt 81 rotates in the rotation direction R2 and the fixing belt 81 rotates in the rotation direction R1, the pressure roller 83 and the fixing belt 81 form the fixing nip N therebetween through which a recording medium S bearing an unfixed toner image T is conveyed.

As shown in FIG. 3, the fixing nip N is planar. Alternatively, the fixing nip N may be concave with respect to the pressure roller 83 or have other shapes. The concave fixing nip N directs a leading edge of the recording medium S toward the pressure roller 83 as the recording medium S is discharged from the fixing nip N, thus facilitating separation of the recording medium S from the fixing belt 81 and thereby suppressing jamming of the recording medium S.

A detailed description is now given of a construction of the fixing belt 81.

The fixing belt 81 is an endless belt or film made of metal such as nickel and SUS stainless steel or resin such as polyimide. The fixing belt 81 is constructed of a base layer and a release layer coating the base layer. The release layer constituting an outer surface layer is made of tetrafluoroethylene-perfluoroalkylvinylether copolymer (PFA), polytetrafluoroethylene (PTFE), or the like to prevent adhesion of toner from the recording medium S to the fixing belt 81. Alternatively, an elastic layer made of silicone rubber or the like may be interposed between the base layer and the release layer. If the fixing belt 81 does not incorporate the elastic layer, the fixing belt 81 has a decreased thermal capacity that improves fixing performance of being heated to a desired fixing temperature quickly. However, as the pressure roller 83 and the fixing belt 81 sandwich and press the toner image T on the recording medium S passing through the fixing nip N, slight surface asperities of the fixing belt 81 may be transferred onto the toner image T on the recording medium S, causing variation in gloss of the solid toner image that appears as an orange peel image. To address this circumstance, the elastic layer has a thickness not smaller than about 100 micrometers. As the elastic layer deforms, the elastic layer absorbs slight surface asperities of the fixing belt 81, preventing formation of the orange peel image.

A detailed description is now given of a configuration of the support 87, the holder pair 88, and the reflector 89.

The support 87 (e.g., a stay) disposed inside the loop formed by the fixing belt 81 contacts and supports the nip formation pad 86 that forms the fixing nip N, preventing the nip formation pad 86 from being bent by pressure from the pressure roller 83 and thereby allowing the nip formation pad 86 to produce the fixing nip N having a nip length in a recording medium conveyance direction A3 that is even throughout the entire width in an axial direction of the fixing belt 81 and the pressure roller 83. Both lateral ends of the support 87 in a longitudinal direction thereof parallel to the axial direction of the fixing belt 81 are mounted on and supported by the holder pair 88 (e.g., flanges), respectively. The reflector 89 is interposed between the heater 82 and the support 87 to shield the support 87 from the heater 82, preventing the support 87 from being heated by the heater 82 unnecessarily and therefore saving energy. Alternatively, instead of mounting the reflector 89, a surface of the support 87 may be treated with insulation or mirror finished to attain the advantages described above.

According to this example embodiment, a halogen heater is used as the heater 82. Alternatively, an induction heater (IH), a resistance heat generator, a carbon heater, or the like may be used as the heater 82.

A detailed description is now given of a construction of the pressure roller 83.

The pressure roller 83 is constructed of a core metal 85, an elastic layer 84 coating the core metal 85 and made of elastic rubber or the like, and a surface release layer coating the elastic layer 84 and made of PFA, PTFE, or the like that facilitates separation of the recording medium S from the pressure roller 83. As the pressure roller 83 receives a driving force transmitted from a driver (e.g., a motor) provided in the image forming apparatus 100 depicted in FIG. 2 through a gear train, the pressure roller 83 rotates in the rotation direction R2. The pressure roller 83 is pressed against the fixing belt 81 by a spring or the like. Accordingly, the elastic layer 84 of the pressure roller 83 is pressed and deformed by the spring, producing the fixing nip N having a desired length in the recording medium conveyance direction A3.

According to this example embodiment, the pressure roller 83 is a solid roller. Alternatively, the pressure roller 83 may be a hollow roller. In this case, a halogen heater may be situated inside the hollow roller. The elastic rubber of the elastic layer 84 is solid rubber. Alternatively, if no heater is situated inside the pressure roller 83, sponge rubber may be used. The sponge rubber is more preferable than the solid rubber because it has an increased insulation that draws less heat from the fixing belt 81.

The fixing belt 81 rotates in accordance with rotation of the pressure roller 83. For example, as described above, as the driver drives and rotates the pressure roller 83 in the rotation direction R2, a driving force of the driver is transmitted from the pressure roller 83 to the fixing belt 81 at the fixing nip N, thus rotating the fixing belt 81 by friction between the pressure roller 83 and the fixing belt 81. Alternatively, the driver may also be connected to the fixing belt 81 to drive and rotate the fixing belt 81. At the fixing nip N, the fixing belt 81 is nipped between the pressure roller 83 and the nip formation pad 86 and is rotated by friction with the pressure roller 83. Conversely, at a position other than the fixing nip N, the fixing belt 81 is rotated while guided by the holder pair 88 (e.g., flanges) at both lateral ends of the fixing belt 81 in the axial direction thereof, respectively.

The fixing device 80 further includes a separator 90 disposed downstream from the fixing nip N in the recording medium conveyance direction A3 to separate the recording medium S from the fixing belt 81. With the construction described above, the fixing device 80 is manufactured at reduced costs and warmed up quickly.

Figure 4:
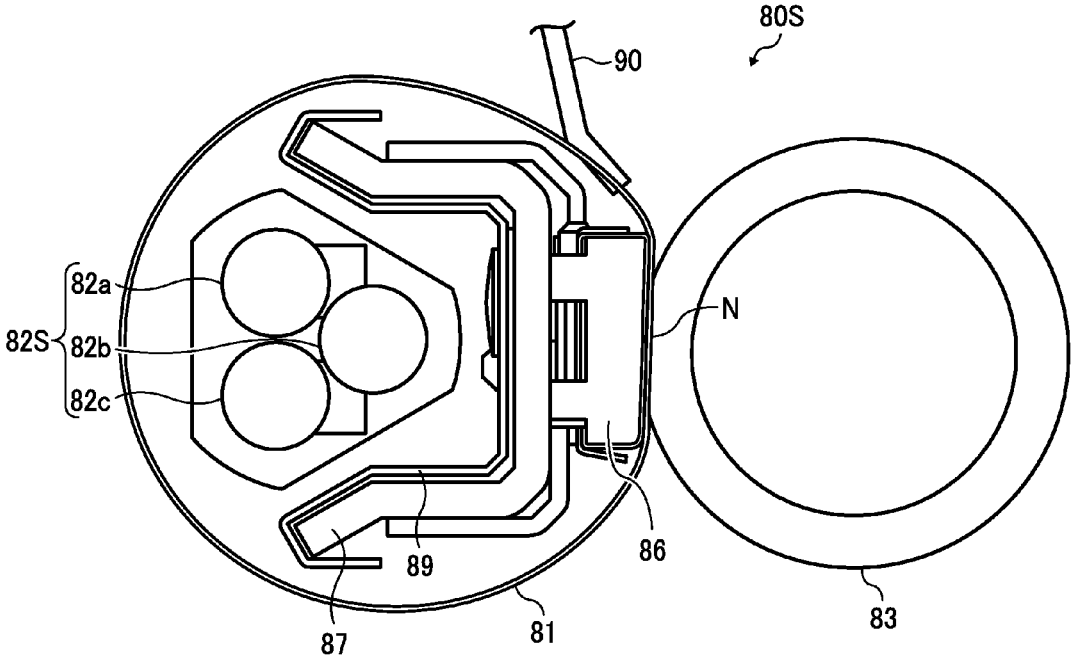
FIG. 4 is a vertical sectional view of a fixing device according to another example embodiment that is installable in the image forming apparatus shown in FIG. 2.

With reference to FIG. 4, a description is provided of a construction of a fixing device 80S according to another example embodiment.

FIG. 4 is a vertical sectional view of the fixing device 80S. The fixing device 80 depicted in FIG. 3 incorporates the single halogen heater as the heater 82. Conversely, the fixing device 80S depicted in FIG. 4 incorporates three halogen heaters 82*a*, 82*b*, and 82*c* as a heater 82S that heats the fixing belt 81.

With reference to FIGS. 5A, 5B, 5C, and 5D, a description is provided of a configuration of a comparative separator 210 and the separator 90 incorporated in the fixing devices 80 and 80S depicted in FIGS. 3 and 4, respectively.

Figure 5A:
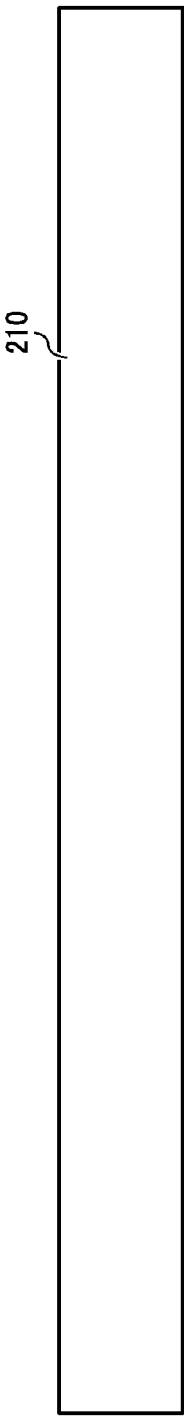
FIG. 5A is a plan view of a comparative separator.
Figure 5B:
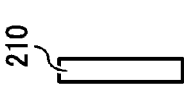
FIG. 5B is a side view of the comparative separator shown in FIG. 5A.
Figure 5C:
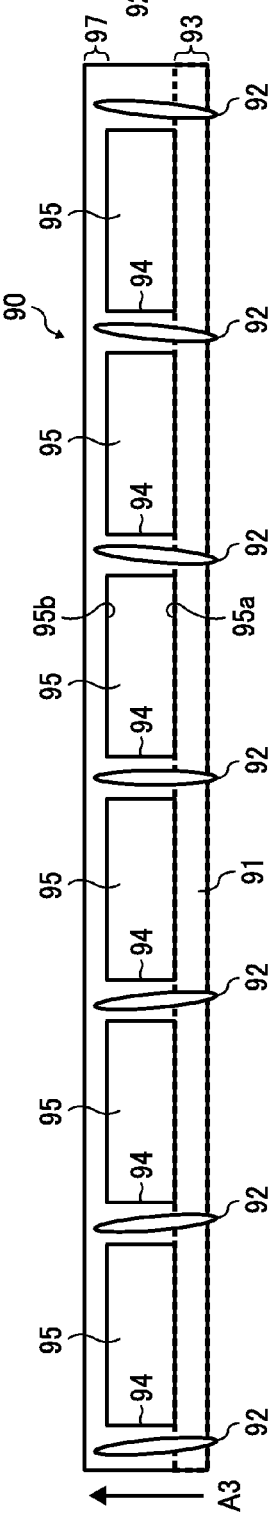
FIG. 5C is a plan view of a separator incorporated in the fixing devices shown in FIGS. 3 and 4.
Figure 5D:
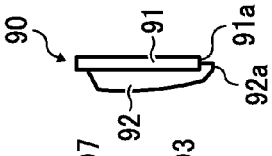
FIG. 5D is a side view of the separator shown in FIG. 5C.

FIG. 5A is a plan view of the comparative separator 210. FIG. 5B is a side view of the comparative separator 210. FIG. 5C is a plan view of the separator 90. FIG. 5D is a side view of the separator 90.

First, with reference to FIGS. 5A and 5B, a detailed description is now given of a configuration of the comparative separator 210.

The comparative separator 210 and the separator 90 are configured to separate the recording medium S discharged from the fixing nip N from the fixing belt 81. If thin paper is used as the recording medium S, the more the leading edge of the recording medium S is adhered with toner, the more the recording medium S is susceptible to being wound around the fixing belt 81, resulting jamming of the recording medium S between the fixing belt 81 and the pressure roller 83. To prevent jamming of the recording medium S, the comparative separators 210 and the separator 90 are configured to peel the recording medium S off the fixing belt 81. For example, the comparative separator 210 is a coated metal plate made of SUS stainless steel that separates the recording medium S from the fixing belt 81 without damaging a surface of the recording medium S. The comparative separator 210 is positioned with respect to the fixing belt 81 precisely.

Figure 6B:
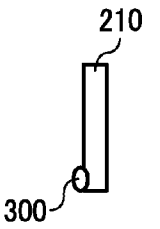
FIG. 6B is a side view of the comparative separator shown in FIG. 6A.
Figure 6A:
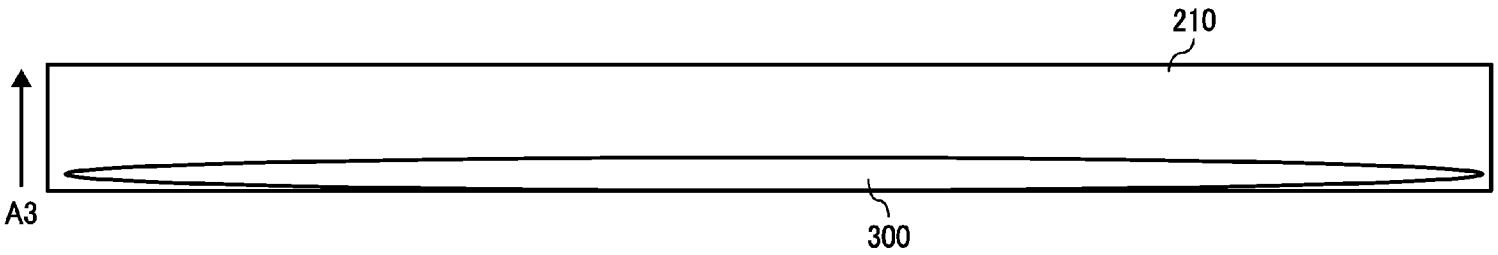
FIG. 6A is a plan view of the comparative separator shown in FIG. 5A illustrating a droplet adhesion region thereon.

However, when a plurality of recording media S is conveyed through the fixing nip N, condensation occurs in a droplet adhesion region 300 on an upstream portion of the comparative separator 210 in the recording medium conveyance direction A3 as shown in FIG. 6A.

With reference to FIGS. 6A and 6B, a description is provided of causes of condensation.

FIG. 6A is a plan view of the comparative separator 210 illustrating the droplet adhesion region 300 thereon. FIG. 6B is a side view of the comparative separator 210 illustrating the droplet adhesion region 300 thereon. The recording medium S, even if it is stored in a general environment, contains moisture in a range of from about 6 percent to about 8 percent. As the heater 82 or 82S heats the fixing belt 81, moisture contained in the recording medium S vaporizes while the recording medium S is conveyed through the fixing nip N. Additionally, when the fixing devices 80 and 80S are heated insufficiently immediately after the heaters 82 and 82S are energized from an energy savor mode of the image forming apparatus 100 in which the heaters 82 and 82S heat the fixing belt 81 to a decreased temperature lower than a desired fixing temperature at which the toner image T is fixed on the recording medium S, the vaporized moisture causes condensation on the comparative separator 210 if it is accommodated in the fixing devices 80 and 80S.

Figure 7:
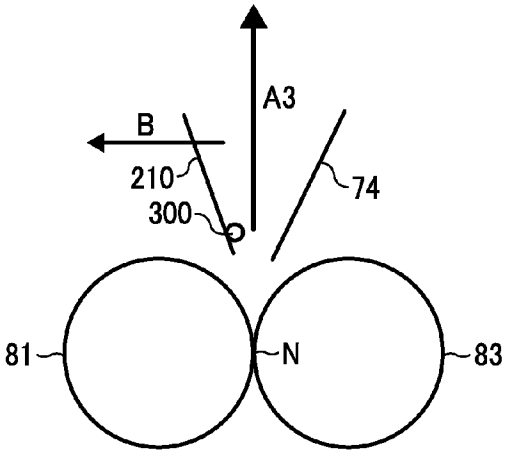
FIG. 7 is a vertical sectional view of a fixing belt, a pressure roller, and the comparative separator shown in FIG. 6A.

FIG. 7 is a vertical sectional view of the fixing belt 81, the pressure roller 83, and the comparative separator 210. As shown in FIG. 7, the comparative separator 210 and a guide 74 are disposed downstream from the fixing nip N in the recording medium conveyance direction A3. If a trailing edge of the recording medium S is deviated from the recording medium conveyance direction A3 and directed toward the comparative separator 210 in a bend direction B when the recording medium S is discharged from the fixing nip N, the recording medium S comes into contact with the comparative separator 210 under condensation. Accordingly, the tailing edge of the recording medium S moistens.

Next, with reference to FIGS. 5C and 5D, a detailed description is now given of a configuration of the separator 90 according to this example embodiment.

As shown in FIGS. 5C and 5D, the separator 90 includes a separation plate 91 formed of a single plate and a rib 92 serving as a projection mounted on the separation plate 91. The separation plate 91 is produced with a plurality of slots 95 each of which is formed substantially in a rectangle having long edges 95*a* and 95*b* parallel to the axial direction of the fixing belt 81 and the pressure roller 83. The plurality of slots 95 spans over a region on the separation plate 91 in the recording medium conveyance direction A3 other than an upstream portion 93 of the separation plate 91 in the recording medium conveyance direction A3. The plurality of slots 95 is aligned in a longitudinal direction of the separation plate 91. The longitudinal direction of the separation plate 91 formed in the single plate shown in FIG. 5C is parallel to the axial direction of the fixing belt 81 and the pressure roller 83.

It is to be noted that the substantially rectangular shape of the slot 95 includes a round rectangle having round corners and shapes close to a rectangle. The round rectangle reduces stress concentration on corners of the slot 95. The size of the round corner is designed properly.

Since the separation plate 91 is produced with the slots 95, the separation plate 91 separates the recording medium S from the fixing belt 81 at a separation portion of the separation plate 91 that is disposed upstream from the slots 95 in the recording medium conveyance direction A3 and closer to the fixing nip N. The separation portion of the separation plate 91 is illustrated as the upstream portion 93 in the dotted line in FIG. 5C.

A longitudinal direction of the substantially rectangular slot 95 is parallel to the axial direction of the fixing belt 81 and the pressure roller 83. A bridge 94 bridges the upstream portion 93 and a downstream portion 97 disposed downstream from the slots 95 in the recording medium conveyance direction A3. That is, the bridge 94 is a gap portion between the adjacent slots 95 aligned in the longitudinal direction of the separation plate 91. The rib 92 spans across the bridge 94 and the upstream portion 93 in the recording medium conveyance direction A3. As shown in FIG. 5D, an upstream edge 92*a* of the rib 92 disposed opposite the fixing nip N projects beyond an upstream edge 91*a* of the separation plate 91 disposed opposite the fixing nip N toward the fixing nip N. The separation plate 91 is made of metal, for example, an alloy of iron as a main ingredient.

Figure 8:
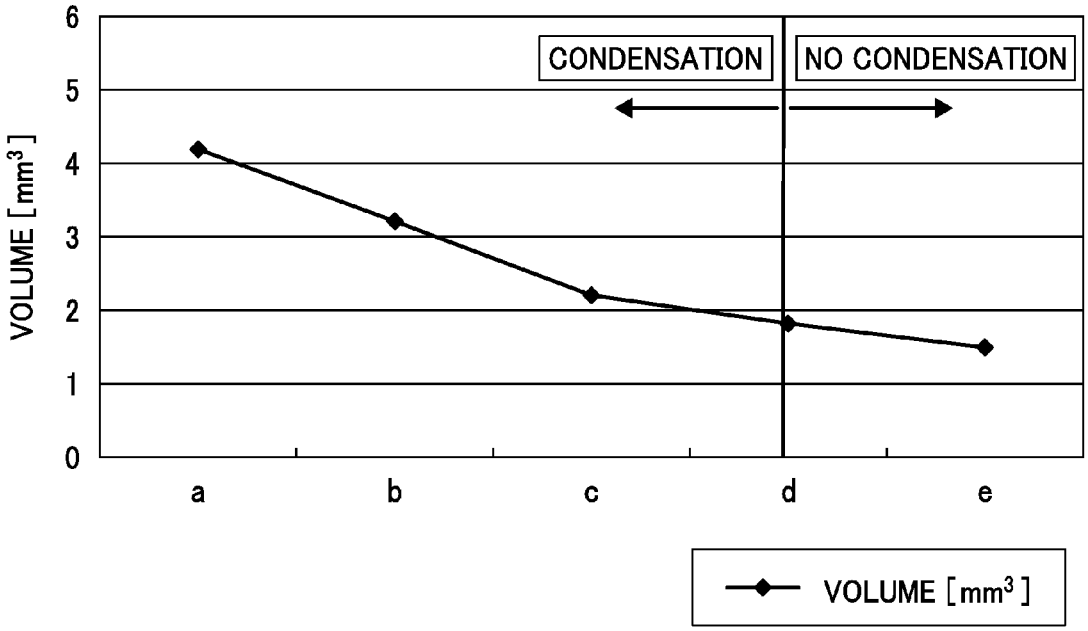
FIG. 8 is a graph showing a relation between the volume of an upstream portion of the separator shown in FIG. 5C and occurrence of condensation.

With reference to FIG. 8, a description is provided of samples showing a relation between the volume per unit length of the upstream portion 93 of the separation plate 91 in the axial direction of the fixing belt 81 and the pressure roller 83 and occurrence of condensation with the separation plate 91 made of SUS stainless steel.

FIG. 8 is a graph showing the relation between the volume of the upstream portion 93 and occurrence of condensation. As shown in FIG. 8, condensation occurs with the upstream portion 93 having the volume not smaller than 2.2 $mm^3$ per unit length of 1 mm of the upstream portion 93 in the axial direction of the fixing belt 81 and the pressure roller 83. Conversely, condensation does not occur with the upstream portion 93 having the volume not greater than 1.8 $mm^3$ per unit length of 1 mm of the upstream portion 93 in the axial direction of the fixing belt 81 and the pressure roller 83. Thus, the separation plate 91 made of an alloy of iron as the main ingredient, if it has the upstream portion 93 having the volume not greater than about 1.8 $mm^3$ per unit length of 1 mm of the upstream portion 93 in the axial direction of the fixing belt 81 and the pressure roller 83, prevents condensation.

If the separation plate 91 is made of an alloy of iron as the main ingredient, even if the separation plate 91 is not made of SUS stainless steel, there is no substantial difference, practically attaining the advantage of preventing condensation with the identical volume per unit length of 1 mm of the upstream portion 93 in the axial direction of the fixing belt 81 and the pressure roller 83. If the separation plate 91 is made of aluminum having a specific heat greater than that of an alloy of iron as the main ingredient, the separation plate 91 is heated quickly and therefore condensation does not occur under the volume greater than that for an alloy of iron as the main ingredient.

Figure 9B:
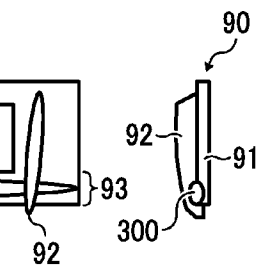
FIG. 9B is a side view of the separator shown in FIG. 9A.
Figure 9A:
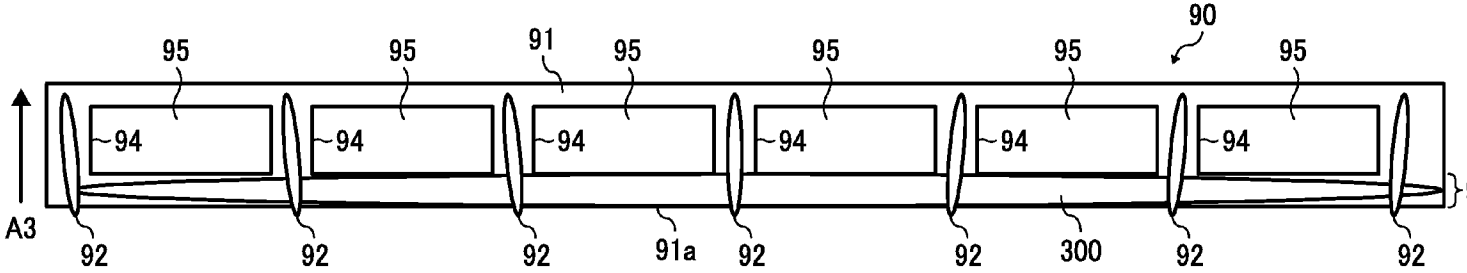
FIG. 9A is a plan view of the separator shown in FIG. 5C illustrating a droplet adhesion region of a separation plate incorporated therein.

As shown in FIG. 5C, the rib 92 serving as a projection is mounted on a portion on a conveyance face of the separation plate 91 over which the recording medium S is conveyed that corresponds to the bridge 94 and the upstream portion 93. A height of the rib 92 is greater than a height of a droplet adhered to the separation plate 91. Accordingly, even if condensation occurs on the droplet adhesion region 300 of the separation plate 91 as shown in FIGS. 9A and 9B, the rib 92 prohibits the recording medium S from coming into contact with the droplet adhesion region 300 of the separation plate 91, thus preventing the droplet from adhering to the recording medium S. FIG. 9A is a plan view of the separator 90 illustrating the droplet adhesion region 300 of the separation plate 91. FIG. 9B is a side view of the separator 90 illustrating the droplet adhesion region 300 of the separation plate 91. Since the shape of the separator 90 makes it difficult to produce projections and depressions on a single component, the projections and depressions are produced on the separation plate 91 by welding or mounting separate components.

Since the separator 90 contacts the recording medium S heated by the heater 82 or 82S, the rib 92 is made of heat resistant resin, for example, fluoroplastic such as PFA resin that facilitates separation of the recording medium S from the separator 90 without scratching the recording medium S. As shown in FIGS. 5C and 9A, a longitudinal direction of the rib 92 is angled relative to the recording medium conveyance direction A3.

The heat capacity of the separator 90 is decreased to prevent the recording medium S from moistening by condensation. It is because the separator 90 inside the fixing devices 80 and 80S is heated quickly, preventing moisture vaporized from the recording medium S from adhering to the separator 90. For example, the separation plate 91 of the separator 90 is produced with the slots 95 and formed in a thin plate to facilitate heating of the upstream portion 93 of the separation plate 91, thus reducing an amount of droplets adhered to the separation plate 91. Although it depends on the structure of the fixing devices 80 and 80S, with the upstream portion 93 of the separation plate 91 having the heat capacity not greater than about 50 percent, the amount of droplets adhered to the separation plate 91 is reduced in half or less.

Figure 10B:
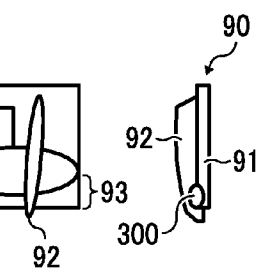
FIG. 10B is a side view of the separator shown in FIG. 10A illustrating one of the spread droplet adhesion regions.
Figure 10A:
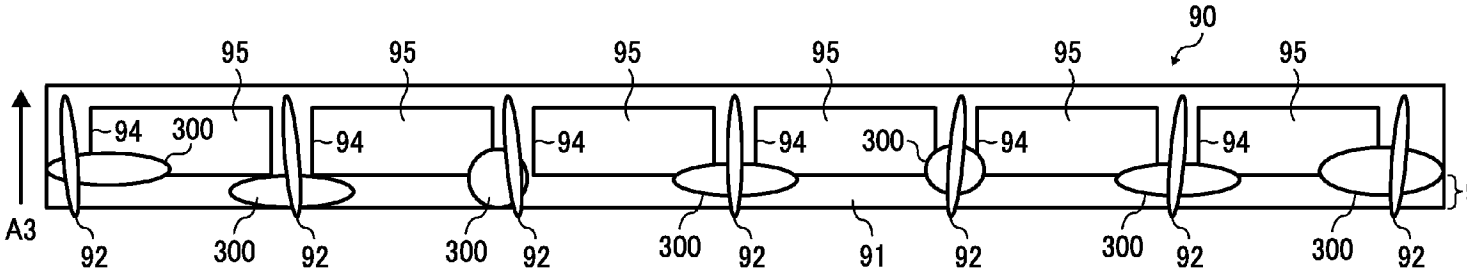
FIG. 10A is a plan view of the separator shown in FIG. 5C illustrating the droplet adhesion regions spread on the separation plate.

However, the reduced heat capacity of the separation plate 91 may decrease the mechanical strength of the separation plate 91 and expand the droplet adhesion region 300 to a portion having an increased heat capacity. For example, as shown in FIG. 9A, the bridges 94 are secured on the separation plate 91 to mount the ribs 92, respectively. If the bridges 94 are eliminated, the recording medium S separated from the fixing belt 81 by the upstream portion 93 of the separation plate 91 may enter the slot 95 and therefore may not be conveyed precisely. Hence, it is impossible to eliminate the bridges 94. However, if a portion of the separation plate 91 other than the bridges 94 has a decreased heat capacity, the bridges 94 have an increased volume. Accordingly, the bridges 94 and the vicinity thereof are susceptible to condensation. Consequently, the droplet adhesion regions 300 are spread on the separation plate 91 as shown in FIG. 10A. FIG. 10A is a plan view of the separator 90 illustrating the droplet adhesion regions 300 spread on the separation plate 91. FIG. 10B is a side view of the separator 90 illustrating one of the spread droplet adhesion regions 300.

Figure 11:
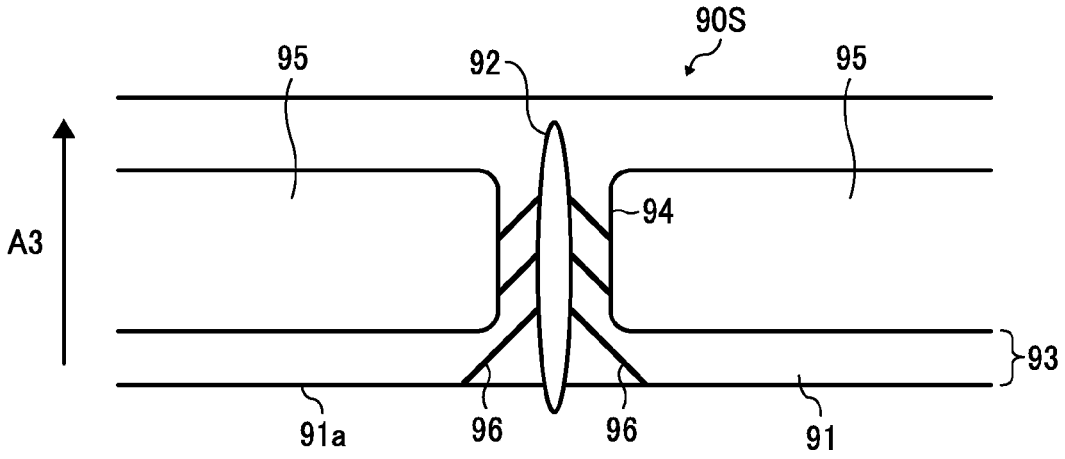
FIG. 11 is a partial plan view of a separator according to yet another example embodiment that is produced with grooves.

Since condensation occurs on the upstream portion 93 of the separation plate 91 and the vicinity thereof, if the upstream portion 93 of the separation plate 91 is eliminated, condensation does not occur. However, the separator 90 may not separate the recording medium S from the fixing belt 81 precisely and the mechanical strength of the separator 90 may degrade. Further, if the recording medium S is jammed between the fixing belt 81 and the pressure roller 83, the separator 90 may be deformed by the recording medium S. Hence, it is impossible to eliminate the upstream portion 93 of the separation plate 91. To address this circumstance, the separation plate 91 is produced with grooves 96 as shown in FIG. 11. FIG. 11 is a partial plan view of a separator 90S produced with the grooves 96.

If droplets adhere to the bridge 94, the droplets may fall down by gravity, adhering to and accumulating on the upstream portion 93 of the separation plate 91 and the ribs 92. If the droplets adhere to the ribs 92, the droplets may move and adhere to the recording medium S conveyed over the ribs 92. To address this circumstance, the bridge 94 is produced with the grooves 96 (e.g., recesses) as channels in which the droplets move to an outside of the bridge 94. Each of the grooves 96 is angled relative to the recording medium conveyance direction A3 and extended from the rib 92 to the upstream edge 91*a* of the separation plate 91 or the slot 95. For example, as shown in FIG. 11, the grooves 96 are angled relative to the recording medium conveyance direction A3 such that the grooves 96 are extended straight from the rib 92 toward the fixing nip N or the upstream edge 91*a* of the separation plate 91 disposed opposite the fixing nip N. The grooves 96 convey the droplets adhered to the bridge 94 to the outside of the separation plate 91, preventing the droplets from accumulating on the upstream portion 93 of the separation plate 91 and therefore preventing the recording medium S from moistening.

Alternatively, the material of the separation plate 91 may be changed to prevent the droplets from adhering to the upstream portion 93 of the separation plate 91. For example, the separation plate 91 may include a porous portion made of moisture osmotic resin that moves moisture from a front, conveyance face of the separation plate 91 that contacts the recording medium S to a back, non-conveyance face of the separation plate 91 opposite the front conveyance face thereof. Since the separation plate 91 having the porous portion is heated more quickly than the separation plate 91 made of metal such as SUS stainless steel, the front, conveyance face of the separation plate 91 is susceptible to adhesion of droplets. To address this circumstance, the porous portion of the separation plate 91 is made of the moisture osmotic resin that accommodates channels in which the droplets move from the front, conveyance face to the back, non-conveyance face of the separation plate 91.

Accordingly, the separation plate 91 reduces adhesion of the droplets to the front, conveyance face thereof, preventing the recording medium S from moistening. Since the recording medium S is not conveyed over the back, non-conveyance face of the separation plate 91, droplets adhered to the back, non-conveyance face of the separation plate 91 do not moisten the recording medium S. Accordingly, by the time when droplets accumulate on the separation plate 91, the separation plate 91 is heated high enough to vaporize moisture. Even if a great amount of droplets is adhered to the separation plate 91, the back, non-conveyance face of the separation plate 91 may mount bristles that absorb droplets. The porous portion is situated at a portion other than the upstream portion 93, for example, at the bridge 94. The ribs 92 that create projections and depressions on the separation plate 91 are designed to prevent the recording medium S from being trapped between the separation plate 91 and the rib 92.

Figure 12A:
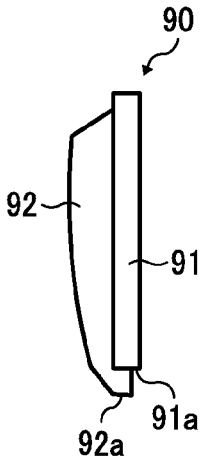
FIG. 12A is a side view of the separator shown in FIG. 5C illustrating a desired configuration of the separation plate and a rib mounted thereon.
Figure 12B:
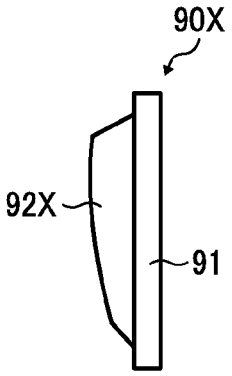
FIG. 12B is a side view of another comparative separator illustrating a faulty configuration of the separation plate and a rib mounted thereon.

With reference to FIGS. 12A and 12B, a description is provided of a configuration of the separation plate 91 and the rib 92 to prevent trapping of the recording medium S.

FIG. 12A is a side view of the separator 90 illustrating a desired configuration of the separation plate 91 and the rib 92. FIG. 12B is a side view of a comparative separator 90X illustrating a faulty configuration of the separation plate 91 and a rib 92X.

If the rib 92X is mounted on the separation plate 91 as shown in FIG. 12B, the recording medium S may be trapped and jammed between the separation plate 91 and the rib 92X. Further, the rib 92X does not resist against a force from the recording medium S conveyed in the recording medium conveyance direction A3. For example, when a plurality of recording media S is conveyed over the comparative separator 90X continuously, the rib 92X is susceptible to rattle and may drop off the separation plate 91. To address this circumstance, as shown in FIG. 12A, the upstream edge 92*a* of the rib 92 disposed opposite the fixing nip N projects beyond the upstream edge 91*a* of the separation plate 91 toward the fixing nip N. Accordingly, the upstream edge 91*a* of the separation plate 91 mounts and retains the rib 92, reducing rattling of the rib 92 and imparting a mechanical strength to the rib 92 that is great enough to resist a force from the recording medium S conveyed in the recording medium conveyance direction A3. Thus, the upstream edge 91*a* of the separation plate 91 disposed opposite the fixing nip N is also produced with projections and depressions created by the ribs 92, preventing droplets from adhering to the recording medium S.

A description is provided of advantages of the fixing devices 80 and 80S incorporating the separators 90 and 90S described above.

As shown in FIGS. 3, 4, and 11, each of the fixing devices 80 and 80S serves as a fixing device that includes a fixing rotary body (e.g., the fixing belt 81) rotatable in a given direction of rotation (e.g., the rotation direction R1); a heater (e.g., the heaters 82 and 82S) to heat the fixing rotary body; a pressing rotary body (e.g., the pressure roller 83) contacting an outer circumferential surface of the fixing rotary body; a nip formation pad (e.g., the nip formation pad 86) situated inside the fixing rotary body and pressing against the pressing rotary body via the fixing rotary body to form the fixing nip N between the fixing rotary body and the pressing rotary body through which a recording medium S is conveyed; a holder pair 88 to hold both lateral ends of the fixing rotary body in an axial direction thereof; and a separator (e.g., the separators 90 and 90S) to separate the recording medium S from the fixing rotary body.

As shown in FIG. 5C, the separator includes the separation plate 91 made of an alloy of iron as the main ingredient and produced with at least one slot 95. The separation plate 91 includes the upstream portion 93 disposed upstream from the slot 95 in the recording medium conveyance direction A3. The upstream portion 93 has a volume not greater than about 1.8 $mm^3$ per unit length of 1 mm of the upstream portion 93 in the longitudinal direction of the separation plate 91 perpendicular to the recording medium conveyance direction A3.

Accordingly, condensation on the upstream portion 93 of the separation plate 91 is suppressed, preventing a droplet from adhering to the recording medium S conveyed over the separator. For example, when the image forming apparatus 100 depicted in FIG. 2 is powered on in the morning or turned on from the energy savor mode in which the fixing device is retained at a decreased temperature, as the recording medium S is conveyed over the separator, a droplet may adhere to the upstream portion 93 of the separation plate 91. It is because moisture of several percent contained in the recording medium S conveyed through the fixing nip N vaporizes and adheres to the upstream portion 93 of the separation plate 91 situated downstream from the fixing nip N in the recording medium conveyance direction A3. Thus, condensation occurs on the upstream portion 93 of the separation plate 91.

In order to prevent a droplet from vaporizing and adhering to the recording medium S, the upstream portion 93 situated upstream from the slot 95 in the recording medium conveyance direction A3 has a decreased volume. Accordingly, the upstream portion 93 of the separation plate 91 situated closest to the fixing nip N is heated quickly, facilitating vaporization of a droplet adhered to the upstream portion 93 of the separation plate 91. Consequently, the droplet adhered to the upstream portion 93 of the separation plate 91 vaporizes quickly, reducing an amount of droplets adhered to the recording medium S.

A separate component, that is, the rib 92 serving as a projection is mounted on the front, conveyance face of the separation plate 91 over which the recording medium S is conveyed such that the rib 92 spans across the upstream portion 93 and the bridge 94. Accordingly, the rib 92 comes into contact with the recording medium S conveyed over the separator to prevent a droplet adhered to the upstream portion 93 of the separation plate 91 from coming into contact with the recording medium S. Consequently, the rib 92 prevents moistening of the recording medium S. Thus, the rib 92 producing projections and depressions at least on the front, conveyance face of the separation plate 91 prevents the droplet from adhering to the recording medium S.

As shown in FIG. 11, at least one groove 96 is produced on the front, conveyance face of the separation plate 91 at a position beside the rib 92 or at a portion other than the slot 95. Accordingly, the groove 96 produces a channel in which a droplet adhered to the separation plate 91 moves. Consequently, droplets readily accumulating on the upstream portion 93 of the separation plate 91 and a portion other than the slot 95 move through the groove 96 and disperse to the outside of the separation plate 91 without accumulating on the separation plate 91. For example, droplets adhered to the separation plate 91 do not accumulate on the upstream edge 92*a* depicted in FIG. 5D of the rib 92 disposed opposite the fixing nip N by gravity and on a portion of the rib 92 that has an increased volume. Thus, the droplets do not adhere to the recording medium S.

The front, conveyance face of the separation plate 91 is produced with the plurality of grooves 96 extending radially from the rib 92 or a portion of the separation plate 91 other than the slot 95. Accordingly, the grooves 96 disperse droplets adhered to the separation plate 91, prohibiting the droplets from accumulating on the upstream portion 93 of the separation plate 91.

The separation plate 91 is partially osmotically porous to produce a channel through which droplets move from the front, conveyance face over which the recording medium S is conveyed to the back, non-conveyance face of the separation plate 91 over which the recording medium S is not conveyed. Accordingly, the separation plate 91 reduces adhesion of the droplets to the upstream portion 93 on the front, conveyance face of the separation plate 91. Consequently, the separation plate 91 osmotically moves the droplets from the front, conveyance face to the back, non-conveyance face of the separation plate 91, reducing adhesion of the droplets to the front, conveyance face of the separation plate 91 and therefore preventing adhesion of the droplets to the recording medium S.

The image forming apparatus 100 incorporating the fixing devices 80 and 80S achieves the advantages of the fixing devices 80 and 80S described above.

The present invention is not limited to the details of the example embodiments described above, and various modifications and improvements are possible. For example, according to the example embodiments described above, the separation plate 91 is constructed of a single plate. Alternatively, the separation plate 91 may be divided into a plurality of plates aligned in the axial direction of the fixing belt 81 and the pressure roller 83.

In order to attain the advantages of the fixing devices 80 and 80S, the fixing devices 80 and 80S shown in FIGS. 3 and 4 include a fixing rotary body (e.g., the fixing belt 81) and a pressing rotary body (e.g., the pressure roller 83) pressed against the fixing rotary body to form the fixing nip N therebetween through which a recording medium S bearing an unfixed toner image T is conveyed. As the recording medium S is conveyed through the fixing nip N, the fixing rotary body heated by a heater (e.g., the heaters 82 and 82S) and the pressing rotary body fix the toner image T on the recording medium S. A separator (e.g., the separators 90 and 90S) separates the recording medium S from one of the fixing rotary body and the pressing rotary body. As shown in FIG. 5C, the separator includes at least the separation plate 91 made of an alloy of iron as the main ingredient and produced with the slot 95 at a position other than the upstream portion 93 disposed opposite the fixing nip N and downstream from the upstream portion 93 in the recording medium conveyance direction A3. The upstream portion 93 has a volume not greater than about 1.8 $mm^3$ per unit length of 1 mm of the upstream portion 93 in an axial direction of one of the fixing rotary body and the pressing rotary body.

Accordingly, the separator prevents adhesion of a droplet thereto and therefore prevents the droplet from adhering to the recording medium S conveyed over the separator.

According to the example embodiments described above, the fixing belt 81 serves as a fixing rotary body. Alternatively, an endless film, a fixing roller, or the like may be used as a fixing rotary body. Further, the pressure roller 83 serves as a pressing rotary body. Alternatively, a pressing belt or the like may be used as a pressing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body configured to be rotatable in a given direction of rotation;

a heater, opposite the fixing rotary body, configured to heat the fixing rotary body;

a pressing rotary body contacting the fixing rotary body configured to form a fixing nip therebetween through which a recording medium is conveyed; and a separator downstream from the fixing nip in a recording medium conveyance direction configured to separate the recording medium from one of the fixing rotary body and the pressing rotary body, the separator including:

a conveyance face over which the recording medium is conveyed;

an upstream edge opposite the fixing nip;

a projection mounted on the conveyance face, wherein a most upstream end of the projection is opposite the fixing nip and projects beyond the upstream edge of the separator toward the fixing nip, and wherein a most downstream end of the projection is on and projects outwardly from the conveyance face of the separator; and a separation plate including:

an upstream portion opposite the fixing nip and having a volume not greater than about 1.8 $mm^3$ per unit length of 1 mm of the upstream portion in an axial direction of one of the fixing rotary body and the pressing rotary body, and at least one slot downstream from the upstream portion in the recording medium conveyance direction.

2. The fixing device according to claim 1, wherein the separator is made of metal.

3. The fixing device according to claim 1, wherein the separator further comprising at least one slot, wherein the at least one slot includes a plurality of slots aligned in the axial direction of the one of the fixing rotary body and the pressing rotary body, and wherein each of the plurality of slots is formed substantially in a rectangle having at least one long edge parallel to the axial direction of the one of the fixing rotary body and the pressing rotary body.

4. The fixing device according to claim 3, wherein the slot is a substantially rectangular shape having round corners.

5. The fixing device according to claim 3, wherein the separator further includes a gap portion provided between adjacent slots of the plurality of slots in the axial direction of the one of the fixing rotary body and the pressing rotary body, and wherein the projection spans across the upstream portion and the gap portion of the separator.

6. The fixing device according to claim 5, wherein the separator further includes at least one groove produced on the gap portion of the separator.

7. The fixing device according to claim 6, wherein the groove extends from the projection to the upstream portion of the separator.

8. The fixing device according to claim 6, wherein the groove extends from the projection to the slot.

9. The fixing device according to claim 6, wherein the groove is angled relative to the recording medium conveyance direction and extends from the projection toward the fixing nip.

10. The fixing device according to claim 1, wherein the projection includes a rib.

11. The fixing device according to claim 1, wherein a longitudinal direction of the projection is angled relative to the recording medium conveyance direction.

12. The fixing device according to claim 1, wherein the separator is partially osmotically porous to move a droplet from a conveyance face of the separator over which the recording medium is conveyed to a non-conveyance face of the separator opposite the conveyance face.

13. The fixing device according to claim 12, wherein the non-conveyance face of the separator mounts bristles to absorb the droplet.

14. The fixing device according to claim 1, wherein the fixing rotary body includes a fixing belt and the pressing rotary body includes a pressure roller.

15. An image forming apparatus comprising the fixing device according to claim 1.

16. The fixing device according to claim 1, wherein a downstream end of the projection is directly on the conveyance face of the separator.

17. A fixing device comprising:

a fixing rotary body configured to be rotatable in a given direction of rotation;

a heater, opposite the fixing rotary body, configured to heat the fixing rotary body;

a pressing rotary body contacting the fixing rotary body configured to form a fixing nip therebetween through which a recording medium is conveyed; and a separator downstream from the fixing nip in a recording medium conveyance direction configured to separate the recording medium from one of the fixing rotary body and the pressing rotary body, the separator including:

a conveyance face over which the recording medium is conveyed;

an upstream edge opposite the fixing nip;

a projection mounted on the conveyance face, wherein a most upstream end of the projection is opposite the fixing nip and projects beyond the upstream edge of the separator toward the fixing nip, wherein a most downstream end of the projection is on and projects outwardly from the conveyance face of the separator, and wherein the separator is partially osmotically porous to move a droplet from a conveyance face of the separator over which the recording medium is conveyed to a non-conveyance face of the separator opposite the conveyance face.

* * * * *